US007222830B2

(12) United States Patent
Sirkin

(10) Patent No.: US 7,222,830 B2
(45) Date of Patent: May 29, 2007

(54) RIGHT ANGLE BRACKET

(75) Inventor: Howard Sirkin, St-Laurent (CA)

(73) Assignee: Métaux Satellite Inc., St-Laurent, Quebec (CA)

( * ) Notice: Subject to any disclaimer, the term of this patent is extended or adjusted under 35 U.S.C. 154(b) by 0 days.

(21) Appl. No.: 11/172,909

(22) Filed: Jul. 5, 2005

(65) Prior Publication Data

US 2007/0007410 A1 Jan. 11, 2007

(51) Int. Cl.
*A47H 1/10* (2006.01)

(52) U.S. Cl. ..... 248/262; 248/217.4; 248/300; 411/466

(58) Field of Classification Search ..... 248/300, 248/250, 217.3, 217.4, 216.4, 254, 262, 264, 248/267, 268; 411/418, 466 X, 467, 468, 411/424

See application file for complete search history.

(56) References Cited

U.S. PATENT DOCUMENTS 2,524,711 A * 10/1950 Nelson ..... 248/264
2,983,179 A * 5/1961 Weinstein ..... 411/424
3,097,821 A * 7/1963 Richards ..... 248/217.3
3,304,106 A * 2/1967 McCormack ..... 403/306
4,115,484 A * 9/1978 Saxton ..... 261/111
4,527,933 A * 7/1985 Karhumaki et al. ..... 411/463
5,074,350 A * 12/1991 Carter ..... 160/178.1 R
5,307,860 A * 5/1994 Wilkinson et al. ..... 160/348
5,544,866 A * 8/1996 Dye ..... 256/69
5,667,178 A * 9/1997 Yang ..... 248/262
5,881,992 A * 3/1999 Evertowski et al. ..... 248/674
2004/0200257 A1* 10/2004 Buttner et al. ..... 72/379.2
2006/0145534 A1* 7/2006 Musselman ..... 305/191

* cited by examiner

*Primary Examiner*—Korie Chan
(74) *Attorney, Agent, or Firm*—Ogilvy Renault LLP

(57) ABSTRACT

A bracket for securing an elongated support member elevated against a wall or adjacent a ceiling for attachment of a window or wall covering, is described. The bracket comprises a single flat metal piece bent to form a top horizontal flange and an integrally formed vertical flange. Holes are provided in at least one of the flanges to receive fasteners therethrough for securement of the bracket. The top horizontal flange has an elongated flat stem punched therefrom and bent out of an inner surface thereof to extend downwardly at an angle about 90° thereto and spaced forwardly of the vertical flange. A plurality of thread indentations are formed in opposed side edges of the stem whereby to receive and retain a threaded nut about the stem.

7 Claims, 1 Drawing Sheet

RIGHT ANGLE BRACKET

TECHNICAL FIELD

The present invention relates to a bracket for securing an elongated support member for attaching a covering for a window opening or wall. The bracket is securable adjacent a ceiling or at the top of a window casing.

BACKGROUND ART

Brackets of all types are known for securement against a wall or ceiling surface whereby to support attachment members for draperies and blinds. One known bracket comprises a right angle flange and wherein on one of the flanges a bolt is inserted and clinched in place by pressure. A wing nut is then attached to the free end of the bolt whereby to retain a wooden board of a thickness of three quarter inch to one inch and to which is affixed covering material or blinds. Velcro strips may also be attached to this board to support valences or other decorative drapery. These brackets also have holes in their flanges for securement to a ceiling or a vertical wall surface or frame.

Although such bracket is simple in design it has several problems associated therewith. One of these problem is that in the manufacture thereof it is necessary to manipulate the bracket several times whereby to place it in a jig and then to mount the bolt at a precise position and then to clinch the bolt into one of the flanges of the bracket at a precise location. The labor involved in the manufacture of the bracket and the use of a bolt adds to the cost of the bracket.

SUMMARY OF INVENTION

It is the feature of present invention to provide a bracket which substantially overcomes the above-mentioned disadvantage of the prior art and which is less expensive to produce.

Another feature of the present invention is to provide a bracket and wherein the bolt is constituted by a flat stem which is punched out of one the flanges of the bracket thus providing an integral attachment with the flange.

Another feature of the present invention is provided bracket which is of light weight and formed from a single flat metal piece and wherein the threads of the flat stem are formed by a plurality of thread indentations formed on opposed side edges of the stem and to which a wing nut is threadably retained.

According to the above features, from a broad aspect, the present invention provides a bracket for securing an elongated support member elevated against a wall or adjacent a ceiling for attachment of a window or wall covering thereto. The bracket comprises a single flat metal piece bent to form a top horizontal flange and an integrally formed vertical flange. Holes are provided in at least one of the flanges to receive fasteners therethrough for securement of the bracket. The top horizontal flange has an elongated flat stem punched therefrom and bent out of an inner surface thereof to extend downward at an angle of about 90° thereto and spaced forwardly of the vertical flange. A plurality of thread indentations are formed in opposed side edges of the stem and are adapted to receive and retain a threaded nut about the stem.

BRIEF DESCRIPTION OF DRAWINGS

A preferred embodiment of the present invention will now be described with reference to the accompanying drawings in which.

DESCRIPTION OF PREFERRED EMBODIMENTS

Figure 2:
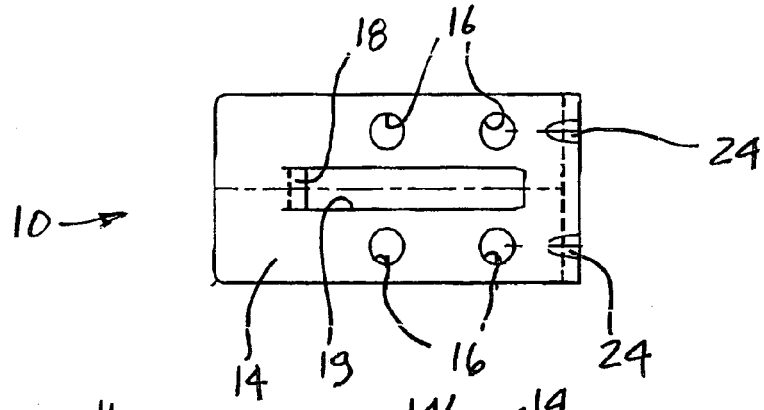
FIG. 2 is a top view of the bracket as illustrated in FIG. 1 showing the construction of the top horizontal flange.

Referring now to the drawings there is shown generally at 10 a bracket constructed in accordance with the present invention for securing an elongated support member 11, hereinshown in phantom lines, elevated against a wall or adjacent a ceiling for attachment of a window or wall covering 12 suspended from the elongated support member 11. As hereinshown the covering or drape 12 is secured to the end edge 11' of the support member 11 by Velcro strips 13.

The bracket 10 is comprised of a single flat rectangular metal piece which is bent to form a top horizontal flange 14 and an integrally formed vertical flange 15. Holes 16 are provided in at least one of the flanges, as herein shown in both flanges 14 and 15, whereby to receive fasteners, such as illustrated in phantom lines at 17, for securing the bracket on a wall or ceiling surface or on a top frame member of a window opening, not shown.

Figure 1:
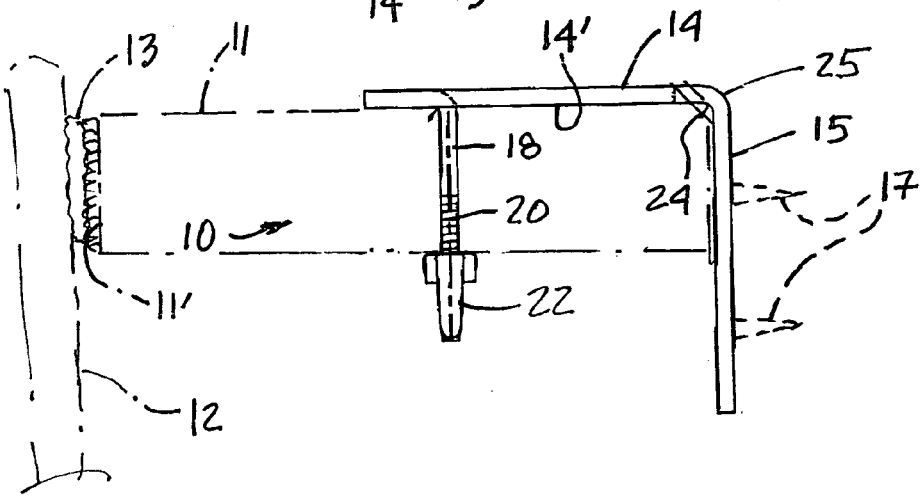
FIG. 1 is a side view illustrating the construction of the bracket of the present invention formed from a single flat metal piece.
Figure 3:
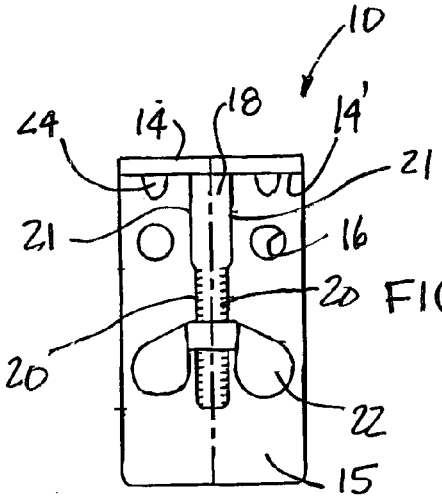
FIG. 3 is a front view of the bracket of FIG. 1 illustrating the construction of the stem and its threaded edges as well as the construction of the vertical flange.
Figure 4:
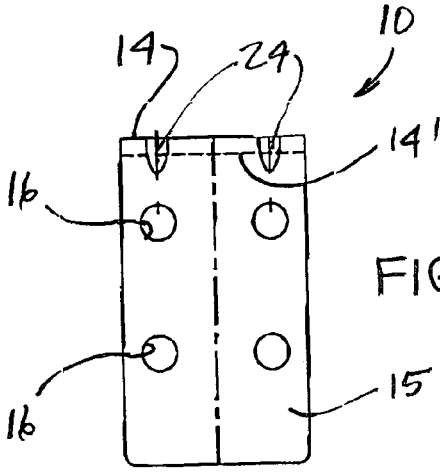
FIG. 4 is a rear view of the vertical flange.

The top horizontal flange 14 has an elongated flat stem 18 punched therefrom thus creating a cavity 19 in the top horizontal flange 14. The stem is bent out of the inner surface 14' of the top horizontal flange 14 and extends downwardly at an angle of about 90° with respect to the inner surface 14' . The stem is also spaced forwardly of the vertical flange 15 and extends substantially parallel thereto. A plurality of thread indentations 20 are then embossed or engraved or punched in opposed side edges 21 of the flat stem 18. These indentations are oriented such as to constitute threads for threadably retaining a nut fastener or a wing nut such as identified by reference numeral 22 in FIGS. 1 and 3. The thread indentations 20 extend in at least a lower portion of the stem 18.

In use two or more of the brackets 10 are secured in position and holes are drilled in the elongated support member 11 at precise locations whereby to receive the threaded stems 18 or the brackets 10 therethrough. A wing nut 22 is then threadably engaged on the stem whereby the elongated support member is wedged against the top horizontal flange. By turning the wing nut the elongated support member is solidly connected to the top horizontal flange of the bracket. Any axial load placed on the flat stem by the wing nut will be transmitted into the top horizontal flange due to the fact that it is integrally formed therewith and prevent the stem from detaching.

In order to structurally retain the transverse relationship between the top horizontal flange 14 and the vertical flange 15, stiffening ribs 24 are punched within the connecting bend 25 of the bracket. It is important for the top horizontal flange to maintain its right angle relationship with the vertical flange when the vertical flange is secured to a vertical wall surface or window frame and the top flange is spaced from a ceiling. In such an installation the load is provided on the top horizontal flange. However, the fact that the support member 11 is wedged in the corner of the bracket between the top horizontal flange and the vertical flange also helps in preventing the top flange from bending under load.

It is within the ambit of the present invention to cover any obvious modifications of the preferred embodiment described herein, provided such modifications fall within the scope of the appended claims.

The invention claimed is:

1. A support bracket for use in combination with an elongated support member for securing said elongated support member elevated against a wall or adjacent a ceiling for attachment of a window or wall covering to said support member, said bracket comprising a single flat metal piece bent to form a top horizontal flange and an integrally formed vertical flange, holes in at least one of said flanges to receive fasteners therethrough for securement of said bracket, said top horizontal flange having an elongated flat stem punched therefrom and bent out of an inner surface thereof to extend downward at an angle about 90° thereto and spaced forwardly of said vertical flange, and a plurality of thread indentations formed in opposed side edges of said stem which receive and retain a threaded nut about said stem, said elongated support member being secured against said inner surface of said top horizontal flange with said stem extending through a hole formed across said elongated support member and said threaded nut secured to said threaded indentations extending out of said hole.

2. A bracket as claimed in claim 1 wherein said holes are provided in both said horizontal and vertical flanges.

3. A bracket as claimed in claim 2 wherein said threaded nut is a wing nut in combination with said stem.

4. A bracket as claimed in claim 2 wherein said thread indentations are provided in a free end section only of said stem.

5. A bracket as claimed in claim 1 wherein said elongated support member is an elongated wood piece of rectangular cross-section.

6. A bracket as claimed in claim 5 wherein said wood piece is secured to two or more of said brackets, and a wall or window covering secured to said wood piece.

7. A bracket as claimed in claim 1 wherein stiffening ribs are formed in a connecting bend of said flat metal piece between said horizontal and vertical flanges.

* * * * *